US006928935B2

(12) United States Patent
Pretzsch et al.

(10) Patent No.: US 6,928,935 B2
(45) Date of Patent: Aug. 16, 2005

(54) INCINERATOR PRE-FILL CHAMBER

(76) Inventors: David Pretzsch, 121 Council St., Carmi, White County, IL (US) 62821; Donald L. Wilson, 121 Council St., Carmi, White County, IL (US) 62821

( * ) Notice: Subject to any disclaimer, the term of this patent is extended or adjusted under 35 U.S.C. 154(b) by 4 days.

(21) Appl. No.: 10/729,030

(22) Filed: Dec. 8, 2003

(65) Prior Publication Data

US 2005/0120926 A1 Jun. 9, 2005

(51) Int. Cl.[7] ..... F23K 3/16; F23G 7/00

(52) U.S. Cl. ..... 110/116; 110/242; 110/293; 110/327; 110/101 R; 110/114; 110/118

(58) Field of Search ..... 110/116, 117, 297, 110/346, 242, 286, 289, 293, 327, 101 R, 110/114, 108, 109, 118

(56) References Cited

U.S. PATENT DOCUMENTS 1,301,371 A * 4/1919 Brennan ..... 110/118
1,705,548 A * 3/1929 Sydow ..... 110/116
3,785,304 A * 1/1974 Stookey ..... 110/346
3,791,319 A * 2/1974 Trott ..... 110/240
4,785,744 A * 11/1988 Fontaine ..... 110/214

* cited by examiner

*Primary Examiner*—Kenneth Rinehart
(74) *Attorney, Agent, or Firm*—Gary K. Price, Esq.

(57) ABSTRACT

An incinerator pre-fill chamber for installation on an incinerator for burning combustible material which allows the operator to continuously re-fill the container of the incinerator with new combustible material while the contents within the container is burning. The incinerator pre-fill chamber includes an elongated case having a first opening aligned in sealing relationship with a second opening disposed in the lid of the incinerator such that when said pre-fill chamber is mounted on the incinerator lid the combustible material can pass from said pre-fill chamber through said first and second openings. The pre-fill chamber further includes a plunger with a platen, at least one side door that opens for loading the material to be burned into the pre-fill chamber, and a trap door that opens when the plunger is actuated thereby permitting the material to pass through the first opening of the pre-fill chamber.

6 Claims, 5 Drawing Sheets

INCINERATOR PRE-FILL CHAMBER

CROSS REFERENCES TO RELATED APPLICATIONS

None.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates to a pre-fill chamber for an incinerator, the type particularly useful for burning various materials.

2. Brief Description of Prior Art.

The field of the present invention relates to an incinerator of the type that generally includes a lid or cover which is removably mounted on a trash container such as a 20 gallon trash can or a 55 gallon drum. The lid has an opening for directing air tangentially into the top of the container upon which it is mounted, and it has a central exhaust opening through which the combustion gases escape from the incinerator. The principle of the prior art incinerator has been to create, at the upper portion of the incinerator, a centrifugal swirl of combusting gases which burn the combustibles from the top down and in so doing tend to retain the combustibles for a long period of time whereby to effect their substantially complete burning.

U.S. Pat. No. 3,791,319 discloses such an incinerator which includes a retardation chamber at the top of the lid and of substantially smaller diameter than the lid rim and bringing air into the top of the retardation chamber. The smaller diameter tends to retain the high velocity of the incoming air before it expands into the larger container. In flowing downwardly into the retardation chamber, it captures and retains for a longer period the upwardly flowing particles. The '319 registration further provides a baffle plate supported below the exhaust opening of the lid. The baffle plate blocks the flow of gases and entrained solids upwardly from the center of the combusting material, causing the gases to be diverted to the perimeter of the incinerator lid. In the parameter of the incinerator lid, the gases and entrained particles are caught into the tangential flow of gases whereby the centrifugal force on the particles tend to retain them in the parameter of the lid until they are significantly more completely burned. Thus, the net effect of the baffle is to increase the residence time of the particles in the incinerator, thereby considerably increasing the extent to which they are combusted.

In application of the prior art incinerator, the lid is removed and the container is filled with the combustible material. The top most combustibles are ignited and the lid is replaced. A blower motor is energized to cause air to circulate in the lid and down upon the combustibles. Very rapidly, a roaring fire is created within the container whose temperature may be 1,500 [deg] F. or higher. The top-down burning creates a long retention time for all of the particles thereby assuring substantially complete combustion. Obviously, the lid of the '319 incinerator must be removed before re-filling the container with combustibles. As such, before removing the lid, any fires within the container must burn-out before re-filling. As such, application of the prior art incinerators requires filling the container, completely burning the material within the container, and once the fire has burned-out, then re-filling the container with combustibles. This is obviously a very time consuming process, especially when there is substantial material to be burned.

As will be seen from the subsequent description, the preferred embodiments of the present invention overcome shortcomings of the prior art.

SUMMARY OF THE INVENTION

The present invention in the preferred embodiment is an incinerator pre-fill chamber attachable to a modified prior art incinerator. The pre-fill chamber of the present invention allows the operator to continuously re-fill the container of the incinerator with new combustible material while the contents within the container is burning. The incinerator pre-fill chamber includes an elongated case, a plunger with a platen, at least one side door that opens for loading the material to be burned, a trap door that opens when the plunger is actuated thereby permitting the material to either fall or be forced by the platen of the plunger into the combustion container where the material is incinerated. The pre-fill chamber further includes trunions, and a handle.

DESCRIPTION OF THE PREFERRED EMBODIMENT

Figure 1:
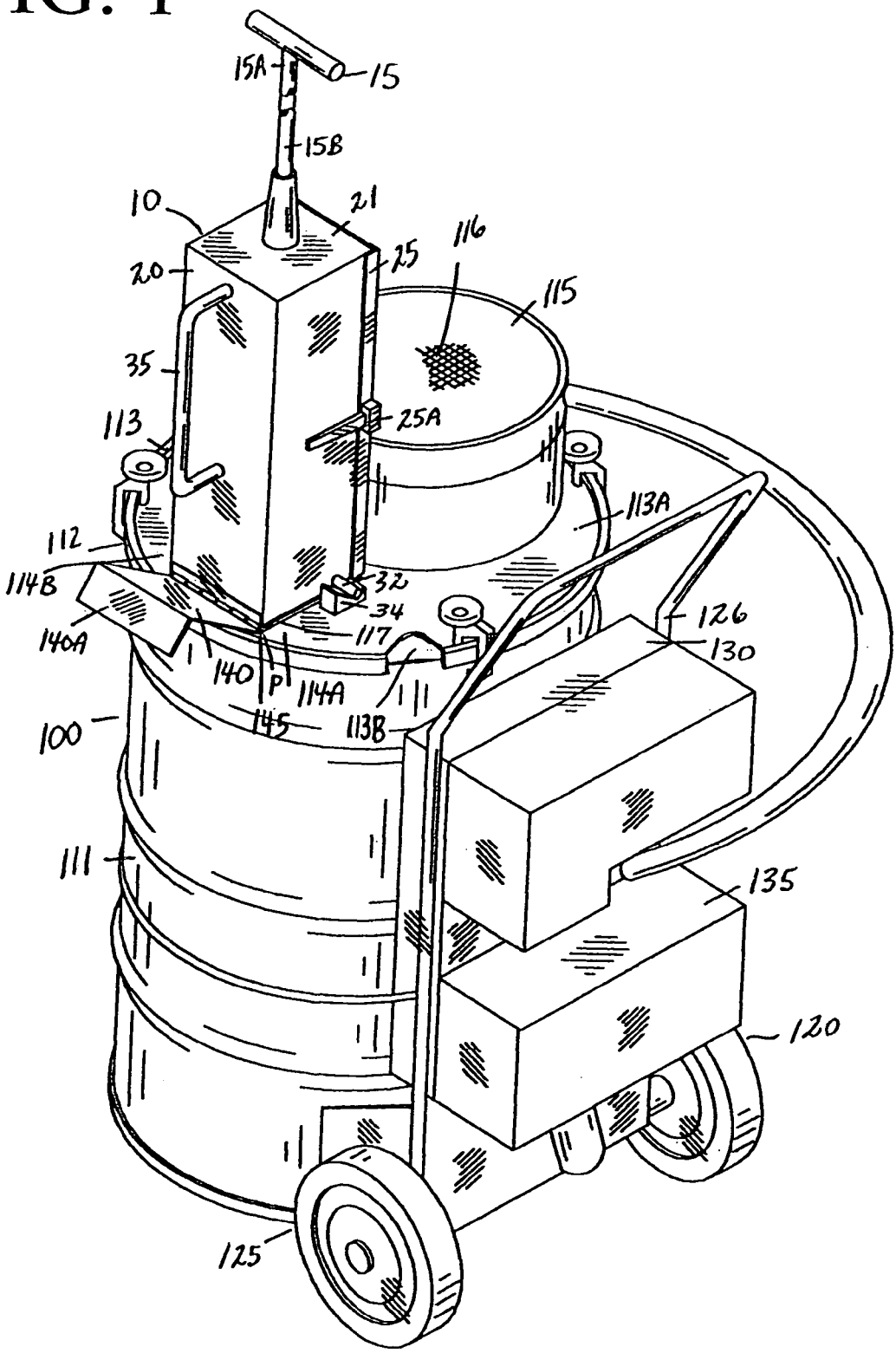
FIG. 1 is a perspective view of a preferred embodiment of the present invention, an incinerator pre-fill chamber installed on a prior art incinerator.

In accordance with the present invention, an incinerator pre-fill chamber for installation on a prior art incinerator is disclosed. The pre-fill chamber relating to a method for continuously burning combustible material within the container of the incinerator. Specifically, it will be noted in the drawings that the incinerator pre-fill chamber relates to an apparatus used for loading combustible material to be burned into the prior art incinerator and introducing that material to the combustible container of the incinerator. In the broadest context, the incinerator pre-fill chamber consists of components configured and correlated with respect to each other so as to attain the desired objective.

FIGS. 1–5 illustrate a preferred embodiment of the incinerator pre-fill chamber in accordance with the present invention. The pre-fill chamber essentially comprising of an elongated case, the case having a side door that opens for loading material to be burned, and a trap door that opens when a plunger is actuated. The design and construction of the incinerator pre-fill chamber allows the chamber to introduce the material to be burned to the combustible container of the incinerator while material is burning within the incinerator. As such, the present invention avoids the practice of the prior art which requires the operator to only load material within the incinerator once the fire within the incinerator has burned-out.

Referring to FIG. 1, which discloses a pre-fill chamber 10 installed on a prior art incinerator 100. The incinerator 100 generally includes a cylindrical container 111, which may be a 55 gallon drum or any other suitable container for the combusting gases. The container 111 has an open upper end 112 onto which a lid 113 is mounted. The lid 113 includes a tangentially directed inlet opening 113B immediately adjacent its top 115. The top 115 has a central exhaust area 116.

The incinerator 100 is, in the preferred embodiment, mounted on a wheeled cart 120 having a horizontal support 125 and a generally vertical handle 126 onto which a plenum chamber 130 and at least one blower 135 are mounted. With this operation, the plenum chamber 130 protects the blower motor 135 from the container 111, maintaining the blower motor's 135 temperature. Again, the configuration of the incinerator 100 as described above is prior art.

Figure 2:
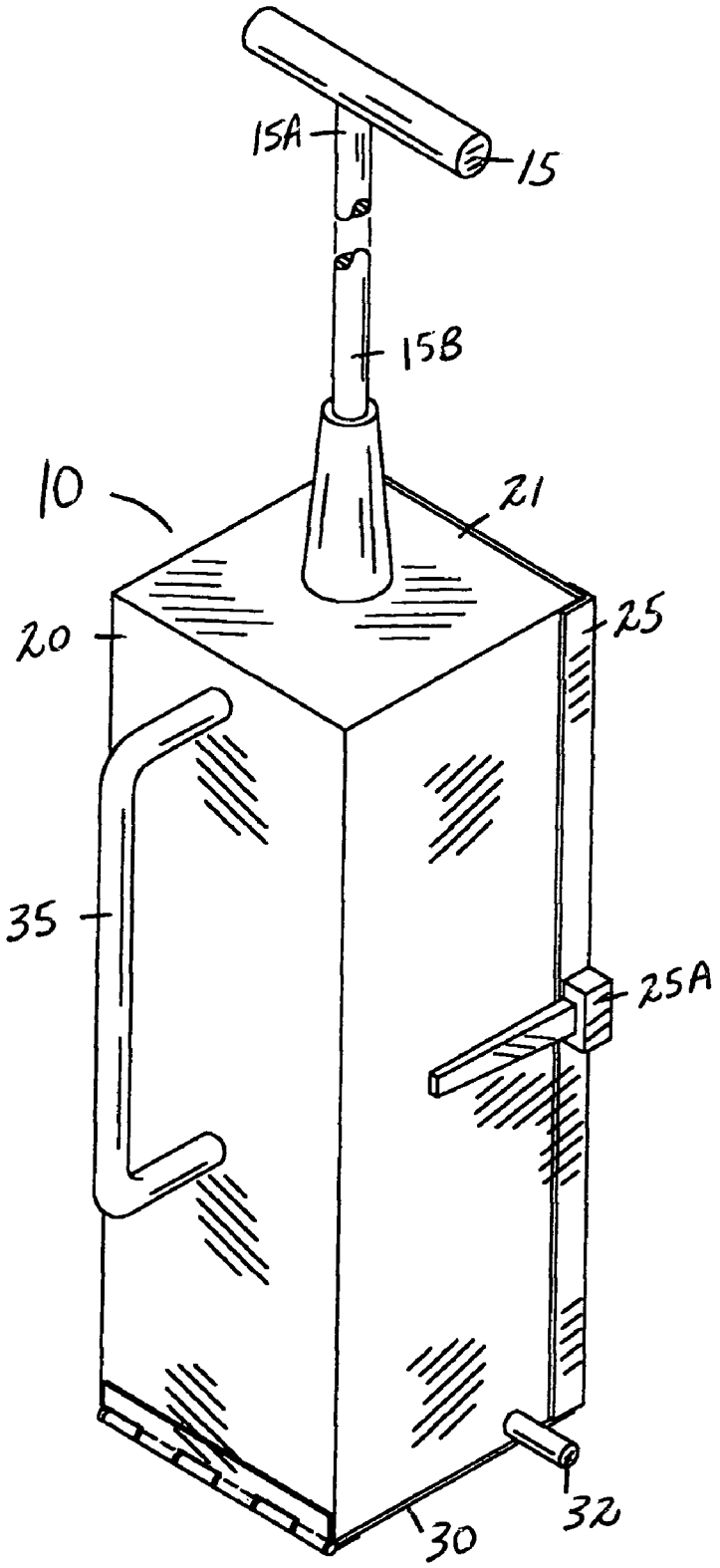
FIG. 2 is a perspective view of the incinerator pre-fill chamber of FIG. 1.
Figure 3:
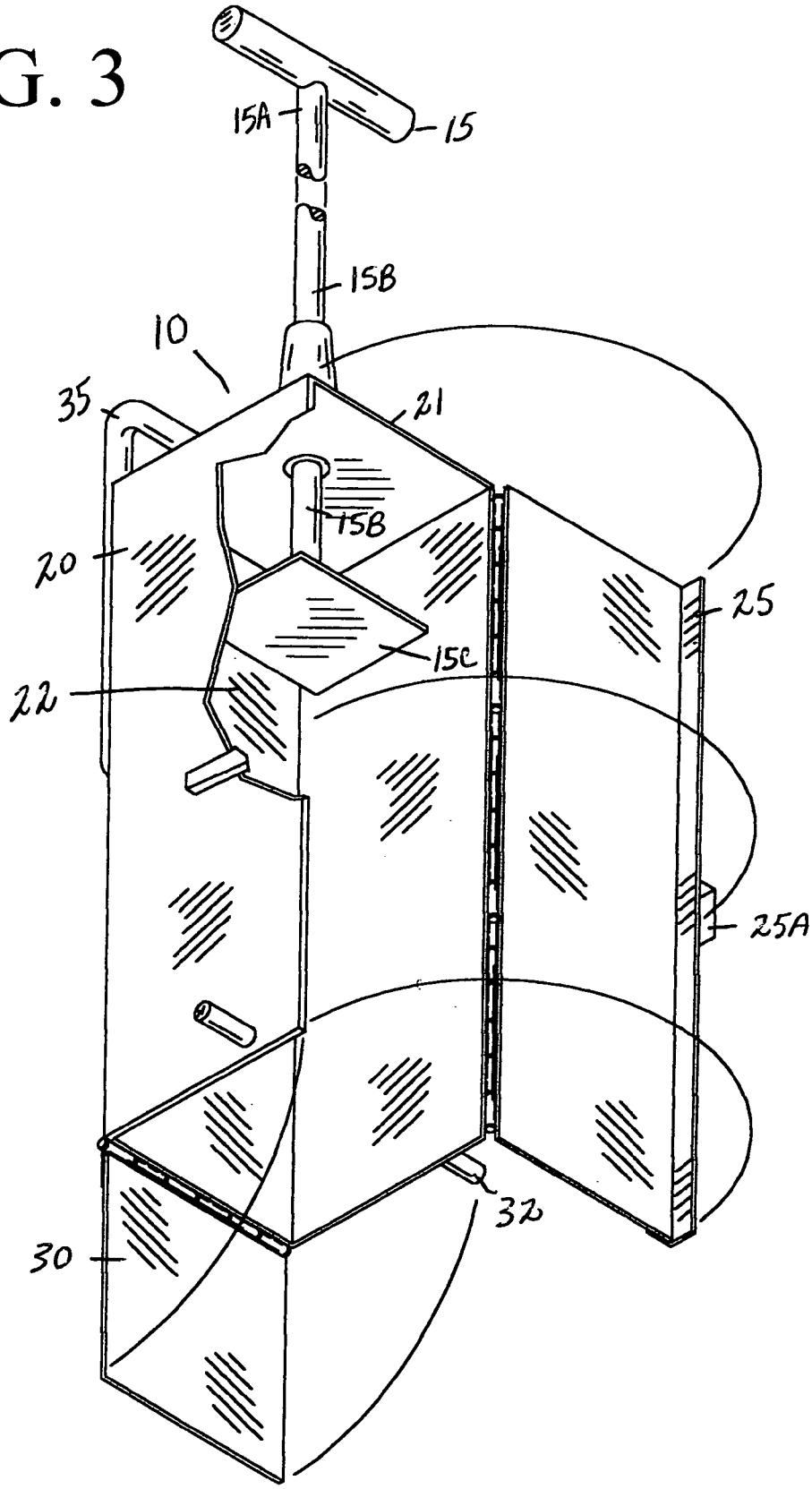
FIG. 3 is a cutaway view of the incinerator pre-fill chamber of FIG. 1, with the side and trap doors in an open position.

Referring now to FIGS. 2 and 3, the pre-fill chamber 10 includes a plunger 15, an elongated case 20, the elongated case 20 including an upper side 21, a side door 25, a trap door 30, a pair of trunions 32 on opposite sides of the case 20, and a handle 35. The case 20 further includes a releasable attaching means 25A known in the art. The attaching means 25A, for releasably latching the side door 25 in a closed position as shown in FIGS. 1 and 2.

As best shown in FIG. 3, the plunger 15 includes a T-handle 15A, a rod 15B that extends through the upper side 21 of the case 20, and a platen 15C attached to the rod 15B. The platen 15C is disposed within a chamber 22 of the case 20. It being understood that the upper side 21 of the case 20 is opposite the trap door 30.

The trap door 30 is hinged to the case 20 and is held in a closed position by friction until forced to an open position by the action of the plunger 15 as will be discussed.

Figure 4:
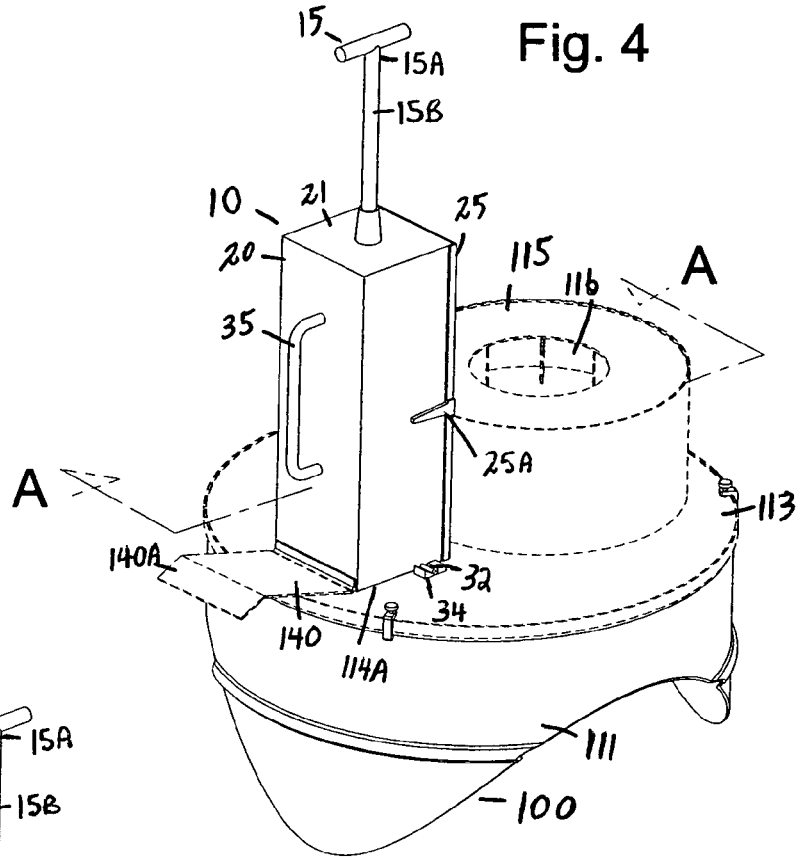
FIG. 4 is a partial view of the incinerator pre-fill chamber of FIG. 1.
Figure 4A:
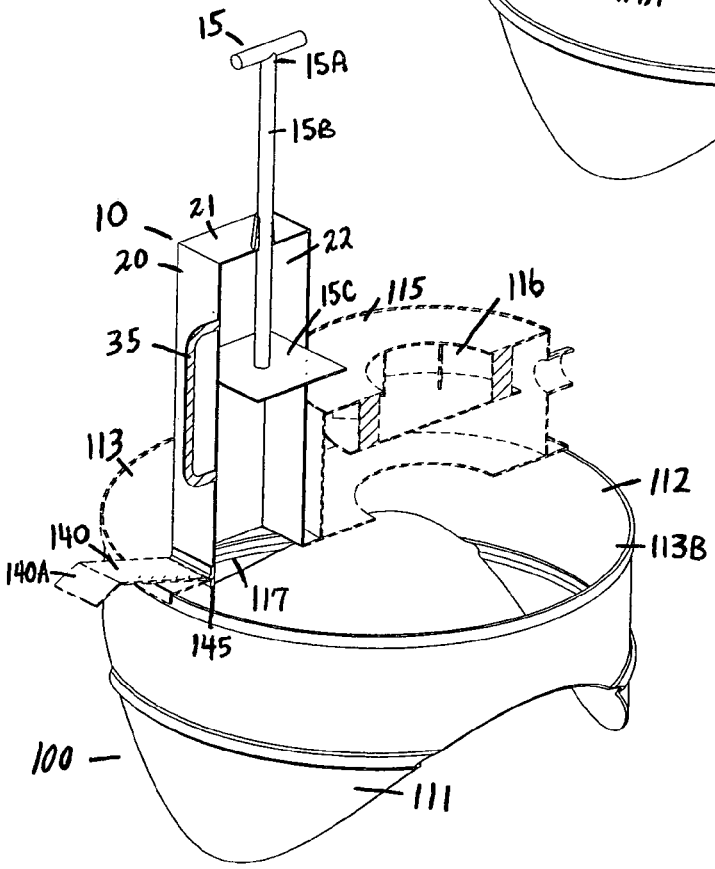
FIG. 4A is a sectional view at line A—A of FIG. 4.
Figure 5:
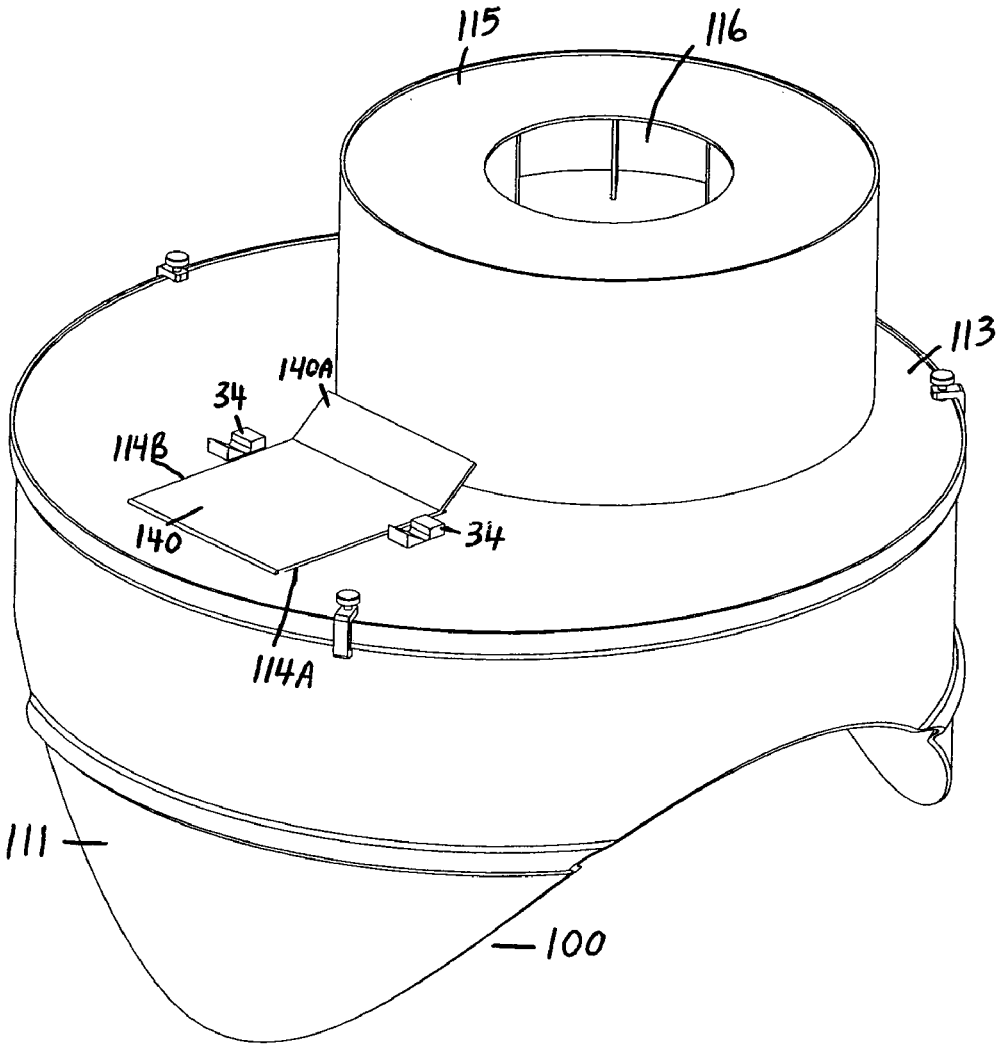
FIG. 5 is a partial view of a prior art incinerator, wherein the hinged closure plate is in a closed position.

As shown in FIGS. 4A and 5, the lid 113 of the incinerator 100 is modified to include an opening 117 sized and shaped to receive the lower portion of the pre-fill chamber 10. A trunion stop 34 is disposed on a first side 114A of the opening 117 and a second trunion stop 34 is disposed on a second side 114B of the opening 117, which second side 114B is opposite the first side 114A of the opening 117. A closure plate 140 having a weighted end 140A is pivotally attached to an edge 145 disposed on the upper surface 113A of the lid 113 at pivot point designated "P" in FIG. 1. The closure plate 140 having a first position and a second position. In the first position (shown in FIG. 5), the closure plate 140 is disposed in a substantially horizontal position such that the plate 140 effectively covers the opening 117 so that the container 111 is completely closed for burning. In the second position, as shown in FIGS. 1 and 4A, the closure plate 140 is pivotally positioned in a substantially vertical position such that the opening 117 receives the pre-fill chamber 10 as will be further discussed.

In application, an operator lays the pre-fill chamber 10 on a convenient surface, then opens the side door 25, retracts the plunger 15, and places the material to be burned within the chamber 22 of the pre-fill chamber 10. The operator verifies that the trap door 30 is closed, and then closes the side door 25 with the material to be burned within the pre-fill chamber 10. The pre-fill chamber 10 is then positioned on the closure plate 140 of the lid 113 of the incinerator 100, so that the trap door 30 is resting on the upper surface of the closure plate 140. The case 20 of the pre-fill chamber 10 is then urged downward so that the closure plate 140 is placed in its second position and the lower portion of the case 20 having the trap door 30 is positioned through the opening 117 and within the container 111 so that the container 111 remains closed with the insertion of the case 20. In this position, the section (shown in FIG. 5) of the closure plate 140 that had the trap door 30 resting thereon is received within container 111 as the case 20 is downwardly urged into the container 111. The case 20 is downwardly urged until the pair of trunions 32 come in contact with the trunion stops 34. The trunion stops 34 serve to keep the pre-fill chamber 10 in place over the opening 117 in the lid 113, and further controls the distance the pre-fill chamber 10 enters the container 111.

The operator then forces the plunger 15 downward, which forces the platen 15C to press the material in the chamber 22 of the pre-fill chamber 10 against the trap door 30, which forces the trap door 30 to swing down into the container 111, which in turn permits the material loaded with the chamber 22 to either fall from or be forced from the chamber 22 into the container 111 for burning.

After the pre-fill chamber 10 is emptied as described above, the operator removes the case 20 of the pre-fill chamber 10 from the container 111 by simply upwardly urging the pre-fill chamber 10 using the handle 35. Once the pre-fill chamber 10 is removed from the container 111, the weighted end 140A of the closure plate 140 will cause the plate 140 to return up to its first position, so that the opening 117 of the container 111 is closed by the closure plate 140 for continued burning. The pre-fill chamber 10 is then removed and may be re-filled with material to be burned as discussed above. As such, the above process may be repeated without requiring the operator to wait until the contents within the container 111 has completely burned.

Use of the pre-fill chamber 10 is an effective way to load said container 111 with material to be burned with minimal exposure to combustion gases and debris. The present invention further avoids the practice of the prior art which requires the operator to only load material within the incinerator once the fire within the incinerator is burned-out.

Although the description above contains many specificities, these should not be construed as limiting the scope of the invention but as merely providing illustrations of some of the presently preferred embodiments of this invention.

It will be obvious to those skilled in the art that modifications may be made to the embodiments described above without departing from the scope of the present invention. Thus the scope of the invention should be determined by the appended claims in the formal application and their legal equivalents, rather than by the examples given.

We claim:

1. A combination pre-fill chamber and incinerator lid, said combination comprising:

a pre-fill chamber mountable adjacent a first opening in said lid, a plunger operable to move a platen through said pre-fill chamber, a second opening, said second opening in said pre-fill chamber such that said first and second opening are aligned in sealing relationship when said pre-fill chamber is mounted on said incinerator lid such that combustible material can pass from said pre-fill chamber through said first and second opening, a side door in said pre-fill chamber, said side door allowing combustible material to be placed in said pre-fill chamber prior to said pre-fill chamber being mounted on said lid, wherein said pre-fill chamber can be moved from a material loading position to a material unloading position wherein said pre-fill chamber is mounted adjacent said first opening in said lid.

2. The combination as recited in claim 1, wherein said second opening is covered by a hinged door.

3. The combination as recited in claim 1, wherein said lid includes an exhaust for an incinerator and latches to attach said incinerator lid to said incinerator.

4. An incinerator for burning combustible material comprising:

a burn container for holding combustible materials, a first material fill opening near an upward portion of said burn container, a lid covering said first material fill opening such that said burn container is closed except for an exhaust and a controlled air plenum, a blower motor controlling a flow of air into said first container through said air plenum, a second opening near an upward portion of said burn container, a closure adapted to cover said second opening, wherein the closure can close when material is no longer being inserted into the second opening, a pre-fill chamber adapted to be filled with material, mounted adjacent said second opening, said pre-fill chamber including a plunger driven platen movable through said pre-fill chamber.

5. The incinerator as recited in claim 4, wherein the closure having a weighted end.

6. The incinerator as recited in claim 4, wherein the closure plate is pivotally attached to an edge disposed adjacent to the second opening defining a pivot point, wherein the closure plate pivots on the pivot point to an open position or a closed position.

* * * * *